US011369821B2

(12) United States Patent
Hong

(10) Patent No.: US 11,369,821 B2
(45) Date of Patent: Jun. 28, 2022

(54) PASSIVE AND ACTIVE DRIVING DEVICE FOR STRENGTHENING MUSCLE

(71) Applicant: AJOU UNIVERSITY INDUSTRY-ACADEMIC COOPERATION FOUNDATION, Suwon-si (KR)

(72) Inventor: Ji Man Hong, Yongin-si (KR)

(73) Assignee: AJOU UNIVERSITY INDUSTRY-ACADEMIC COOPERATION FOUNDATION, Suwon-si (KR)

( * ) Notice: Subject to any disclaimer, the term of this patent is extended or adjusted under 35 U.S.C. 154(b) by 518 days.

(21) Appl. No.: 16/066,063

(22) PCT Filed: Dec. 29, 2016

(86) PCT No.: PCT/KR2016/015496

§ 371 (c)(1),
(2) Date: Jun. 26, 2018

(87) PCT Pub. No.: WO2017/116175

PCT Pub. Date: Jul. 6, 2017

(65) Prior Publication Data

US 2020/0282254 A1 Sep. 10, 2020

(30) Foreign Application Priority Data

Dec. 31, 2015 (KR) ..... 10-2015-0190804

(51) Int. Cl.

| | |
|---|---|
| ***A61H 1/02*** | (2006.01) |
| ***A63B 21/00*** | (2006.01) |
| ***A63B 24/00*** | (2006.01) |

(52) U.S. Cl.
CPC ..... *A63B 21/00178* (2013.01); *A61H 1/02* (2013.01); *A61H 1/024* (2013.01);
(Continued)

(58) Field of Classification Search
CPC ..... A61H 1/02; A61H 1/0237; A61H 1/024; A61H 1/0244; A61H 1/0255
See application file for complete search history.

(56) References Cited

U.S. PATENT DOCUMENTS 4,509,509 A * 4/1985 Bouvet ..... A61H 1/0255 601/15
4,825,852 A * 5/1989 Genovese ..... A61H 1/0259 482/901

(Continued)

FOREIGN PATENT DOCUMENTS

KR 10-2011-0050839 A 5/2011
KR 10-1099063 B1 12/2011

(Continued)

OTHER PUBLICATIONS

International Search Report for PCT/KR2016/015496 dated Mar. 20, 2017 from Korean Intellectual Property Office.

*Primary Examiner* — Michael J Tsai
(74) *Attorney, Agent, or Firm* — Revolution IP, PLC

(57) ABSTRACT

A muscle-strengthening passive and active motion device includes: a joint supporter supporting a body part that is bendable or stretchable with a joint region; a driver driving the joint supporter by being combined to the joint supporter; and a controller controlling the driver, wherein the controller is capable of accelerating or decelerating a driving speed of the joint supporter.

6 Claims, 3 Drawing Sheets

(52) U.S. Cl.
CPC ..... *A61H 1/0277* (2013.01); *A63B 21/4011* (2015.10); *A63B 21/4021* (2015.10); *A63B 21/4033* (2015.10); *A63B 24/0087* (2013.01); *A61H 2201/1638* (2013.01); *A61H 2201/1642* (2013.01)

(56) References Cited

U.S. PATENT DOCUMENTS 5,280,783 A * 1/1994 Focht ..... A61H 1/0259 601/34
5,333,604 A * 8/1994 Green ..... A61H 1/0255 601/33
5,399,147 A * 3/1995 Kaiser ..... A61H 1/0255 601/16
5,620,411 A * 4/1997 Schumann ..... A61F 5/0111 128/882
5,901,581 A * 5/1999 Chen ..... A61H 1/0259 601/34
6,221,032 B1 * 4/2001 Blanchard ..... A61H 1/024 601/23
7,282,035 B2 * 10/2007 Huang ..... A61H 1/0237 601/33
9,956,130 B2 5/2018 An et al.
2004/0049139 A1 3/2004 Craciunescu
2006/0064044 A1 * 3/2006 Schmehl ..... A61H 1/024 601/34
2008/0304935 A1 * 12/2008 Scott ..... A61H 1/0262 414/5
2009/0163837 A1 * 6/2009 Sanger ..... A61H 1/024 601/5
2013/0085420 A1 * 4/2013 Feinstein ..... A61F 7/007 601/5
2014/0031728 A1 * 1/2014 Guillen ..... A61H 1/00 601/34
2018/0104130 A1 4/2018 Sampson et al.
2018/0116895 A1 5/2018 Ikeuchi

FOREIGN PATENT DOCUMENTS

KR 10-2012-0100613 A 9/2012
KR 10-2014-0109090 A 9/2014
KR 10-2018-0023485 A 3/2018

* cited by examiner

PASSIVE AND ACTIVE DRIVING DEVICE FOR STRENGTHENING MUSCLE

TECHNICAL FIELD

The present disclosure relates to a motion device, and more particularly, to a muscle-strengthening passive and active motion device capable of strengthening a muscle by accelerating or decelerating a speed of bending or stretching a body part with a joint region, or by changing a direction in which a body part is moved.

BACKGROUND ART

Continuous passive motion (CPM) apparatuses are apparatuses designed to move a joint at a constant speed by setting a range of motion of the joint such that the joint does not become stiff after injury.

The CPM apparatuses were conceptualized by Robert B. Salter in 1970, and are commercially available mainly in orthopedics to be used for various joints, such as knee, ankle, shoulder, and wrist joints. Recently, the CPM apparatuses have been used in stroke patients. Such CPM apparatuses only result in an increase in a range of motion of joints.

An increase in muscle strength may be classified into sarcoplasmic hypertrophy, an increase in muscle endurance, an increase in actual muscle strength, and an increase in maximum muscle strength. The increase in actual muscle strength may be caused by an increase in muscle cell hypertrophy and muscle cell number. To cause changes in such muscle cells, physical use of muscles needs to be repeatedly induced, and in particular, repetitive anaerobic motion needs to be executed to enhance intramuscular protein use, fat and carbohydrate storage capacity, and neovascularization.

However, a patient who cannot move is unable to go through such processes because he/she cannot move by him/herself, and may have a tragic ending as muscles gradually shrink. In this regard, a physical therapist visits a chronic patent who is lying down, such as a stroke patient, to perform physical therapy for strengthening a muscle, but since the physical therapist has limited time to perform physical therapy, the physical therapy may not be sufficient enough to strengthen the muscle. Also, when the physical therapy is not properly performed and the muscle is not strengthened, rehabilitation treatment may be unable to be added and performed in earnest.

Current direct physical therapy of a physical therapist is not enough to strengthen a muscle of a patient who cannot move, and due to inability to participate in a physical therapy performed in a physical therapy clinic because of the unstrengthened muscle, which leads to muscle weakening, the patient may not recover or finish his/her life in bed. Thus, there is a desperate need for means to strengthen a muscle of a patient who cannot move, such as a stroke patient.

Accordingly, the inventor of the present disclosure has developed a device for strengthening a muscle of a patient.

DESCRIPTION OF EMBODIMENT

Technical Problem

Provided is a muscle-strengthening passive and active motion device enabling a muscle to strengthen by including acceleration and deceleration functions.

Solution to Problem

According to an aspect of the present disclosure, a muscle-strengthening passive and active motion device includes: a joint supporter supporting a body part that is bendable or stretchable with a joint region; a driver driving the joint supporter by being combined to the joint supporter; and a controller controlling the driver, wherein the controller is capable of accelerating or decelerating a driving speed of the joint supporter.

The joint supporter may include: a support supporting the body part and moving while the body part is bent or stretched; and a fastening unit fastening a distal end region of the body part.

The joint supporter may further include a shock-absorbing unit at a region where a distal end of the body part contacts.

The driver may include: a power generator generating power; and a power transmitter combined to the power generator and driving the joint supporter by using the power from the power generator.

The controller may randomly accelerate or decelerate a driving speed of the joint supporter.

The controller may selectively change a driving direction of the joint supporter.

The fastening unit may further include a strap for wrapping around and fastening a distal end of the body part.

The fastening unit may have a plate shape, and one surface of the fastening unit, which contacts the distal end region of the body part, may have a groove corresponding to the distal end region of the body part.

The fastening unit may include: an insertion unit where the distal end region of the body part is insertable; and an air inlet for injecting air into the insertion unit.

The fastening unit may further include a body distal end accommodator capable of wrapping around the distal end region of the body part and formed of a smooth material.

Advantageous Effects of Disclosure

The present disclosure can generate tension on a muscle by including acceleration and deceleration functions, and thus the muscle can be effectively strengthened.

The present disclosure generates tension on a muscle by changing a bending and stretching direction of a body part with a joint region, and thus the muscle can be effectively strengthened.

Since the present disclosure can bend or stretch a body part with a joint region, contracture of a relevant joint can be prevented, while atrophy of adjacent muscles can be prevented and the adjacent muscles can be developed.

Since the present disclosure includes a shock-absorbing pad, comfortable contact feeling can be provided to a patient and sensitive skin of the patient may be prevented from being damaged.

Since the present disclosure includes a link structure, a body part with a joint region can be smoothly bent or stretched, and thus skin and soft tissues of a patient can be prevented from being damaged.

The present disclosure is configured to gradually accelerate or decelerate at a moment when selective acceleration, deceleration, and moving directions are changed, thereby preventing damage to sensitive skin through safe movement.

The present disclosure enables even a immobilized patient to repeatedly move anaerobically by applying repetitive irregular tension to a muscle, and thus the muscle can be effectively strengthened.

The present disclosure can be applied to joint contracture treatment, a stroke patient for muscle function enhancement, and a patient suffering from muscle weakness.

BEST MODE

According to an aspect of the present disclosure, a muscle-strengthening passive and active motion device includes: a joint supporter supporting a body part that is bendable or stretchable with a joint region; a driver driving the joint supporter by being combined to the joint supporter; and a controller controlling the driver, wherein the controller is capable of accelerating or decelerating a driving speed of the joint supporter. Accordingly, a bending or stretching direction of the body part with the joint region may be changed to generate tension on a muscle, and thus the muscle may be effectively strengthened.

Mode of Disclosure

Figure 1:
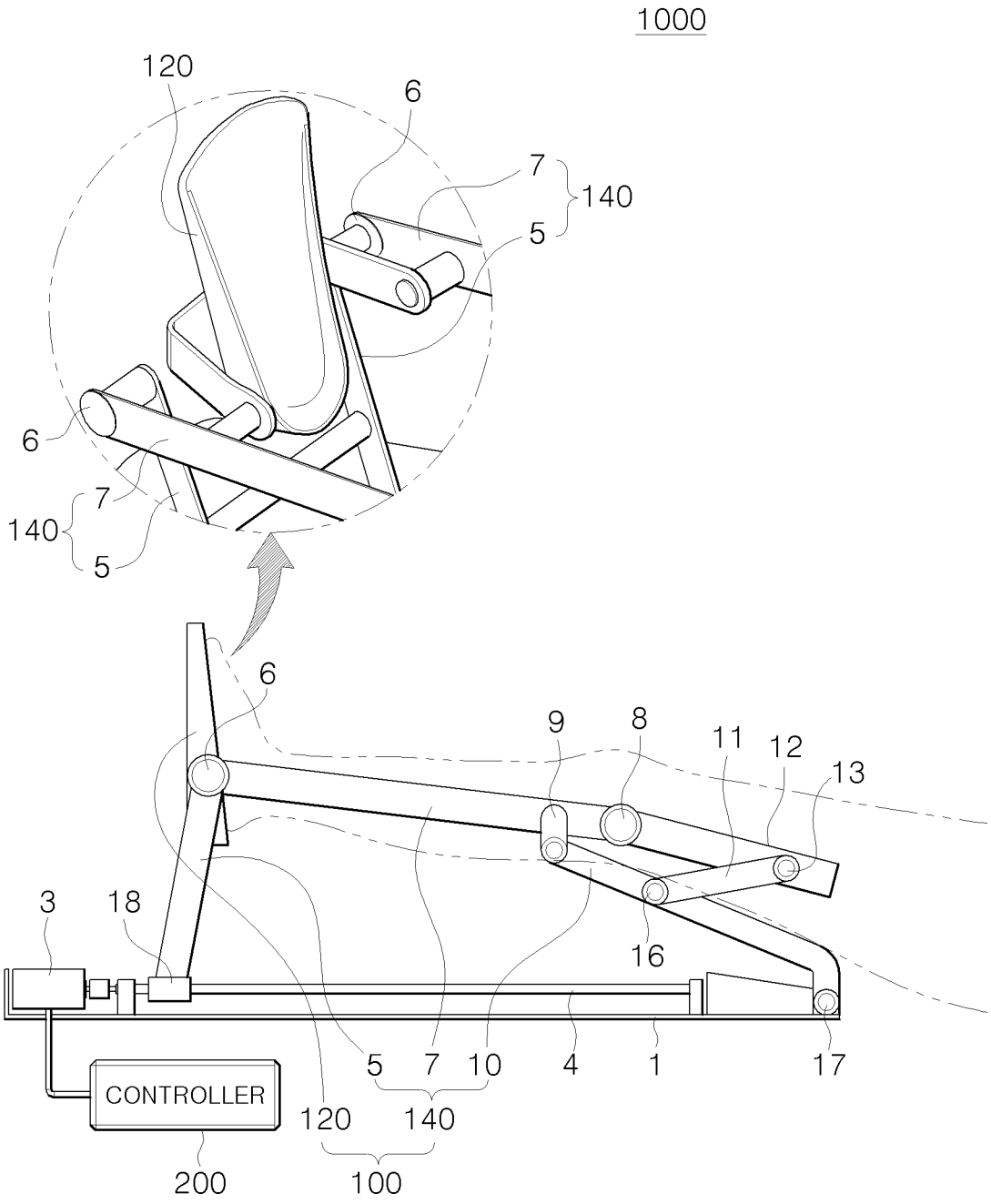
FIG. 1 is a diagram for describing a muscle-strengthening passive and active motion device according to an embodiment of the present disclosure.
Figure 2:
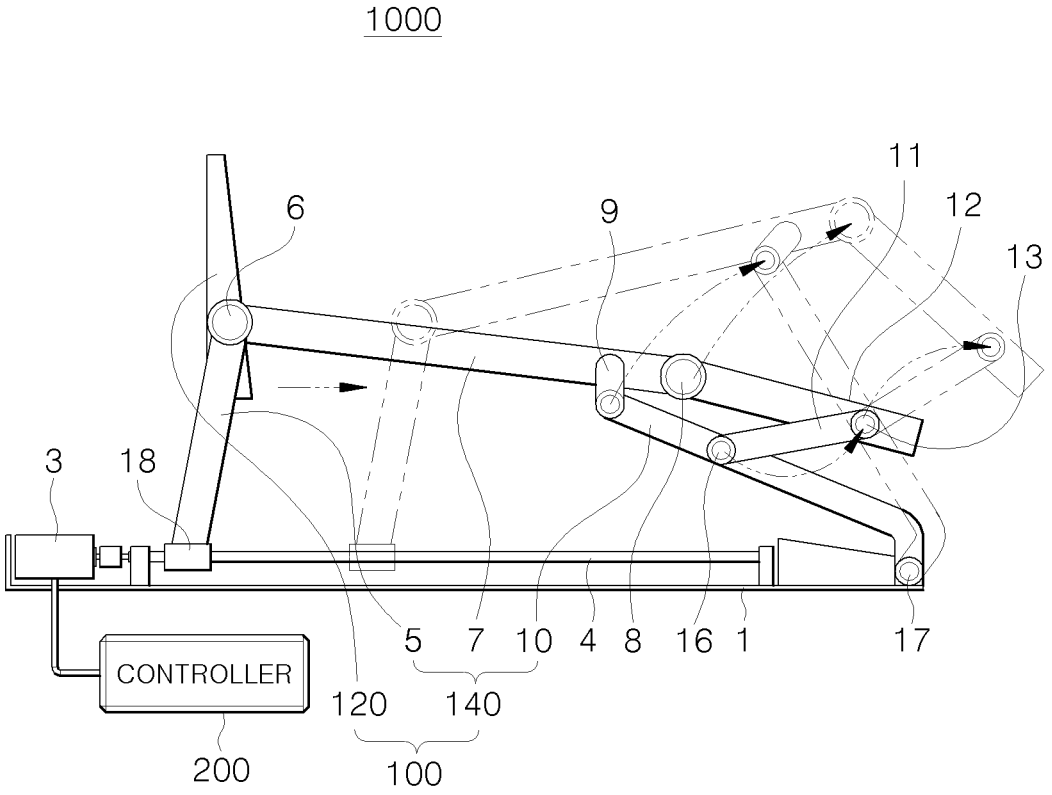
FIG. 2 is a diagram for describing an operating state of a muscle-strengthening passive and active motion device, according to an embodiment of the present disclosure.

FIG. 1 is a diagram for describing a muscle-strengthening passive and active motion device according to an embodiment of the present disclosure, and FIG. 2 is a diagram for describing an operating state of the muscle-strengthening passive and active motion device, according to an embodiment of the present disclosure.

Referring to FIGS. 1 and 2, the muscle-strengthening passive and active motion device 1000 according to an embodiment of the present disclosure may include a joint supporter 100, drivers 3 and 4, and a controller 200.

The joint supporter 100 supports a body part with a joint region when the body part is bent or stretched. The joint supporter 100 may include a support 140 driven while supporting the body part when the body part is bent or stretched, and a fastening unit 120 combined to the support 140 and fastening a distal end region of the body part.

For example, the support 140 may include a front plate 5, a top plate 7, and a rear plate 10. The front plate 5 may move back and forth in a straight line, and when the rear plate 10 is driven according to such a straight back-and-forth movement, the top plate 7 connected between the front plate 5 and the rear plate 10 moves upward or downward. According to such a movement, the body part may perform a joint bending motion while being fastened to the fastening unit 120 described below.

The fastening unit 120 is a unit for fastening a distal end region of the body part, and for example, may have a plate shape with a groove corresponding to a shape of a sole of a foot. The fastening unit 120 may include a strap for wrapping around the distal end region of the body part while the distal end region contacts the fastening unit 120, or as another example, although not illustrated, the fastening unit 120 may be configured itself to wrap around the distal end region of the body part to wrap around and fasten the distal end region. For example, the fastening unit 120 may include an insertion unit into which the distal end region of the body part may be inserted, and an air inlet for injecting air into the insertion unit. When the distal end region of the body part is inserted into the insertion unit into which a distal end region is insertable, air is injected to expand the insertion unit such that the distal end region is fastened to the fastening unit 120. In this case, the fastening unit 120 may be formed of a flexible polymer material. As another example, the fastening unit 120 may further include a body distal end accommodator (not shown) capable of wrapping around the distal end region and formed of a smooth material, and the body distal end accommodator may be inserted into the fastening unit 120. For example, a sock or a stocking formed of a smooth material may be used as the body distal end accommodator, and skin of a patient may be prevented from being damaged by contacting the fastening unit 120 by putting a stocking on a foot of the patient and inserting the foot into the fastening unit 120.

For example, a shock-absorbing pad (not shown) for preventing damage to skin of the distal end region may be provided on one surface of the fastening unit 120, i.e., on a surface where the fastening unit 120 and the distal end region contact each other. The shock-absorbing pad may be formed of an elastic material, for example, a polymer material. By providing the shock-absorbing pad, comfortable contact feeling may be provided to the patient and sensitive skin of the patient may be prevented from being damaged.

The drivers 3 and 4 may be combined to the joint support 100 to drive the joint support 100 according to control of the controller 200. In this regard, the drivers 3 and 4 may include a power generator 3 and a power transmitter combined to the power generator 3 and driving the joint supporter 100 by using power generated by the power generator 3. According to an embodiment, the power generator 3 may be any apparatus capable of converting electric energy to mechanical energy, such as a motor, a hydraulic cylinder, or the like. When the power generator 3 is a motor, a forward/reverse drivable motor may be used. According to another embodiment, the power transmitter 4 may be a screw capable of transmitting power, a shaft having a long rod shape and a smooth surface, or the like.

According to an embodiment, when the power generator 3 is a motor and the power transmitter 4 is a screw, the screw supported by a frame 1 is driven when the motor 3 rotates, and the front plate 5 connected to the power transmitter 4 via a nut 18 moves forward in a direction of the patient (to a right direction in FIG. 1). Also, when the motor rotates in an opposite direction, the front plate 5 again moves backward in a direction opposite to the direction of the patient. When the front plate 5 moves forward, the rear plate 10 pivots around a third link 17, and when the rear plate 10 pivots, the top plate 7 connected through a second link 9 receives upward force and is driven by using a first link 6 as a shaft. As a result, the top plate 7 is lifted by the rear plate 10, and a uniform driving angle is formed between the top plate 7 and the rear plate 10. A knee joint may be bent by the driving angle formed between the top plate 7 and the rear plate 10. Also, when the front plate 5 moves backward, operations opposite to the above descriptions are performed, and thus the top plate 7 descends and the driving angle between the top plate 7 and the rear plate 10 disappears. When the driving angle disappears, the knee joint is stretched back again. As such, the front plate 5 repeatedly moves backward and forward to bend and stretch the knee joint of the patient placed on the top plate 7.

According to another embodiment, when the power generator 3 is a hydraulic cylinder and the power transmitter 4 is a shaft having a smooth surface, and when the hydraulic cylinder generates power of moving a piston in the direction of the patient, the nut 18 moves along a surface of the shaft and the front plate 5 moves forward in the direction of the patient. When the hydraulic cylinder generates power of moving the piston in the direction opposite to the direction of the patient, the nut 18 moves in a direction opposite to the previous direction along the surface of the shaft and the front plate 5 moves backward.

As such, the knee joint of the patient is bent and stretched.

Also, an extension plate 12 is provided at an end portion of the top plate 7 through a fourth link 8, and a support member 11 is connected between the extension plate 12 and the rear plate 10 through a fifth link 16 and a sixth link 13. According to such a structure, when the front plate 5 moves in a straight line, the rear plate 10 pivots around the third link 17 to pull the extension plate 12 downward via the support member 11. When the extension plate 12 is pulled downward, the top plate 7 receives upward force, and thus the driving angle between the top plate 7 and the rear plate 10 is increased and at the same time maintains an accurate angle. Accordingly, the bending motion of the leg is accurately and uniformly repeated at the increased driving angle, thereby enabling effective therapy.

Since the muscle-strengthening passive and active motion device 1000 according to an embodiment of the present disclosure uses a link structure, i.e., the first link 6, the fourth link 8, the second link 9, the sixth link 13, the fifth link 16, and the third link 17, the body part with the joint region may be smoothly bent or stretched, and thus skin and soft tissues of the patient may be prevented from being damaged.

The muscle-strengthening passive and active motion device 1000 according to an embodiment of the present disclosure may further include a force sensor (not shown) for detecting force exerted from a body. For example, the force sensor may be inserted into the fastening unit 120 and detect force exerted from the body by contacting the distal end region of the body. Here, a pressure sensor or the like may be used as the force sensor. The force sensor may detect whether force is exerted and measure magnitude of the exerted force.

When the force exerted by the force is detected by the force sensor, the controller 200 may change a driving speed and driving direction of the joint supporter 100 driven by the drivers 3 and 4. For example, when the patient stretches the knee, the force sensor may detect the force exerted from the body of the patient, and in this case, the controller 200 may control the drivers 3 and 4 to drive the joint supporter 100 in a direction where the knee of the patient is stretched. On the other hand, when the patient bends the knee, the controller 200 may control the drivers 3 and 4 to drive the joint supporter 100 in a direction where the knee of the patient is bent.

Also, when the force exerted from the body is detected, the controller 200 may control the drivers 3 and 4 to further increase the driving speed of the joint supporter 100. For example, when force exerted from the body of the patient is detected while the patient is stretching the knee, the controller 200 may control the drivers 3 and 4 to drive the joint supporter 100 in the direction where the knee is stretched and at the same time, increase the driving speed in the direction where the knee is stretched, such that the patient moves smoothly.

The controller 200 may control the driving speed and the driving direction the drivers 3 and 4 drive the joint supporter 100. For example, the controller 200 may accelerate or decelerate a rotating speed of the motor 3 so as to control a speed at which the drivers 3 and 4 bend or stretch the body part. Also, the controller 200 may control a rotating direction of the motor 3 to move the front plate 5 forward or backward.

As another example, the controller 200 may accelerate or decelerate a speed at which the piston of the hydraulic cylinder moves to control the speed at which the drivers 3 and 4 bend or stretch the body part. Also, the controller 200 may control a moving direction of the piston of the hydraulic cylinder to move the front plate 5 forward or backward.

In order to strengthen a muscle, it is important to generate irregular tension according to inertia on a muscle around a joint by repeating bending and stretching motions of the joint and at the same time, accelerating or decelerating bending or stretching speeds in real-time, stretching the joint again before the joint is completely bent, or bending the joint again before the joint is completely stretched. In this regard, the controller 200 may change at least one of a driving direction, and acceleration and deceleration of a driving speed of the joint supporter 100. For example, when the knee is stretched while being bent or is bent while being stretched, tension is generated in a muscle around the knee, and the muscle may be strengthened by such tension. Also, tension is also generated in the muscle around the knee when a speed at which the knee is bent is accelerated and then decelerated or is decelerated and then accelerated, and thus the muscle may be strengthened. In order to efficiently strengthen a muscle, acceleration and deceleration of the driving speed of the joint supporter 100, and the driving direction of the joint supporter 100 may be selectively changed.

Also, the controller 200 may be configured to be capable of feedback control so as to prevent damage to skin and soft tissues of the body, the damage caused by changes in acceleration and deceleration of the driving speed of the joint supporter 100 or changes in the driving direction of the joint supporter 100. For example, the controller 200 may control the joint supporter 100 so as to gradually change the acceleration or deceleration of the driving speed of the joint supporter 100, or gradually change the driving direction of the joint supporter 100. For example, when the driving speed of the joint supporter 100 is decelerated while being accelerated, the acceleration of the joint supporter 100 may be reduced by 10% at each time so as to prevent damage to the skin and soft tissues of the body. As another example, when the driving speed of the joint supporter 100 is changed, the acceleration may be gradually reduced from a certain point of time before the driving direction is changed, and then gradually increased up to a certain point of time after the driving direction is changed, so as to prevent damage to the skin and soft tissues of the body.

The muscle-strengthening passive and active motion device 1000 according to an embodiment of the present disclosure may further include a vibrating device (not shown) for vibrating the body part. For example, a vibration motor may be used as the vibrating device. For example, the vibrating device may be provided at the fastening unit 120 and the controller 200 may control the vibrating device. The vibrating device may be provided at the fastening unit 120, but may alternatively be provided at at least one of the front plate 5, the top plate 7, and the rear plate 10 of the support 140 as long as the vibrating device has a function of vibrating the body part. When the body part is vibrated through the vibrating device, a blood flow in a muscle may be increased, and thus blood may further smoothly circulate and the muscle may be strengthened. The vibrating device may be configured such that strength of vibration is adjustable and configured to vibrate even while the body part is bending or stretching.

The muscle-strengthening passive and active motion device 1000 according to an embodiment of the present disclosure may be formed of a material that is light and at the same time, solid, such as aluminum or carbon fiber, so as to simultaneously obtain light weight and solidity, but the material is not limited thereto.

The muscle-strengthening passive and active motion device 1000 according to an embodiment of the present disclosure may be configured to be used by a patient while lying down. For example, the muscle-strengthening passive and active motion device 1000 according to an embodiment of the present disclosure may be driven passively or actively while the patient is comfortably lying down by bending or stretching the body part of the patient while a bottom surface of the frame 1 contacts a bed or the floor, and thus the patient may exercise easily and comfortably.

Figure 3:
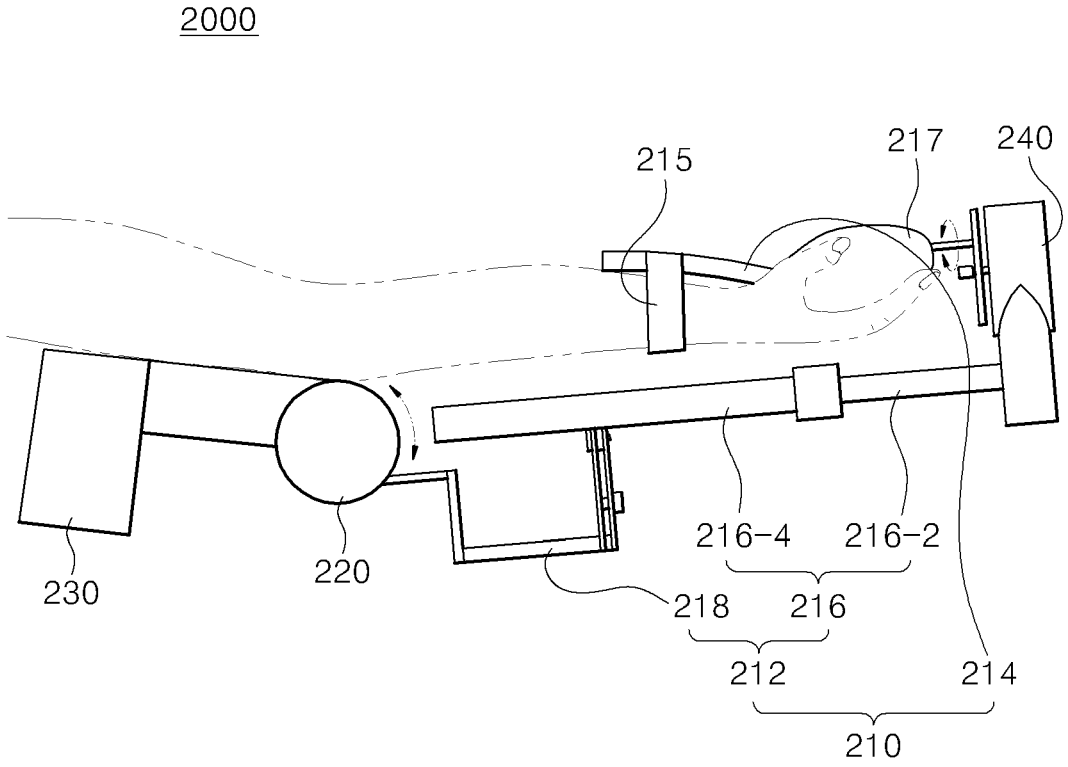
FIG. 3 is a diagram for describing a muscle-strengthening passive and active motion device according to another embodiment of the present disclosure.

FIG. 3 is a diagram for describing a muscle-strengthening passive and active motion device according to another embodiment of the present disclosure.

Referring to FIG. 3, a muscle-strengthening passive and active motion device 2000 according to another embodiment of the present disclosure may include a joint supporter 210, a driver 220, and a controller 230.

The body supporter 210 supports a body part with a joint region when the body part is bent or stretched. In FIG. 3, the body part is an arm. The joint supporter 210 may include a support 212 driven while supporting the body part when the body part is bent or stretched, and a fastening unit 214 combined to the support 212 and fastening a distal end region of the body part.

For example, the support 212 may include a length adjustable portion 216 that has a rod shape and is stretchable, and a pivot portion 218 combined to the length adjustable portion 216 and rotating the length adjustable portion 216.

The length adjustable portion 216 may include a first rod 216-2 and a second rod 216-4, wherein a diameter of the first rod 216-2 may be smaller than a diameter of the second rod 216-4, and the first rod 216-2 may be configured such as to move along a length direction of the second rod 216-4 while being inserted into the second rod 216-4 and fixed to the second rod 216-4 after moving to a desired location. Since lengths of arms of patients vary, the length adjustable portion 216 may be adjusted according to a length of an arm such that the joint supporter 210 may support the arm.

The pivot portion 218 is connected to the driver 220 described below, and may rotate according to the driver 220. When the driver 220 is driven, the pivot portion 218 rotates, and when the pivot portion 218 rotates, the support 212 pivots.

The fastening unit 214 is a unit for fastening a distal end region of the body part, and for example, a groove (not show) where a wrist is accommodated may be formed on one side of the fastening unit 214, and a strap 215 for wrapping around the wrist may be provided at the fastening unit 214. Also, the fastening unit 214 may include a handle 217 having, for example, a hemisphere shape, which may be held with a hand while contacting a palm. The arm may be comfortably fastened to the fastening unit 120 when the patient holds the handle 217 with the hand while the wrist is fastened to the fastening unit 120. For example, a shock-absorbing pad (not shown) for preventing damage to skin of the distal end region of the body may be provided at one surface of the fastening unit 120, i.e., on a surface where the fastening unit 120 and the distal end region of the body contact each other. The shock-absorbing pad may be formed of an elastic material, for example, a polymer material. By providing the shock-absorbing pad, comfortable contact feeling may be provided to the patient and sensitive skin of the patient may be prevented from being damaged.

The driver 220 may be connected to the joint supporter 210 and drive the joint supporter 210. For example, the driver 220 may be connected to one end portion of the joint supporter 210 and rotate the joint supporter 210. For example, a forward/reverse drivable motor may be used as the driver 220, and a rotating shaft of the motor and the pivot portion 218 may be combined to each other such that the pivot portion 218 may rotate along a rotating direction of the rotating shaft of the motor.

The controller 230 may control a driving speed and a driving direction of the joint supporter 210 driven by the driver 220. The controller 230 may control the driving speed to gradually accelerate or decelerate, and control the driving direction to be in a forward/reverse direction. For example, the controller 230 may control a speed at which the driver 220 bends or stretches a body part by accelerating or decelerating a rotating speed of the motor.

The muscle-strengthening passive and active motion device 2000 according to another embodiment of the present disclosure may further include a body distal end moving unit 240 capable of moving a body distal end region.

The body distal end moving unit 240 may be combined to the support 212 and the fastening unit 214, between the support 212 and the fastening unit 214. For example, a forward/reverse rotatable motor may be used as the body distal end moving unit 240, and a rotating shaft of the motor and the fastening unit 214 may be combined to each other such that the fastening unit 214 is rotated according to a direction in which the rotating shaft of the motor rotates.

The wrist may be rotated through the body distal end moving unit 240, and thus muscles of the wrist may be relaxed and muscles around the wrist may be strengthened.

In order to strengthen a muscle, it is important to generate irregular tension according to inertia on a muscle around a joint by repeating bending and stretching motions of the joint and at the same time, accelerating or decelerating bending or stretching speeds in real-time, stretching the joint again before the joint is completely bent, or bending the joint again before the joint is completely stretched. In this regard, the controller 230 may change at least one of a driving direction, and acceleration and deceleration of a driving speed of the joint supporter 210. For example, when an elbow is stretched while being bent or is bent while being stretched, tension is generated in a muscle around the elbow, and the muscle may be strengthened by such tension. Also, tension is also generated in the muscle around the elbow when a speed at which the knee is bent is accelerated and then decelerated or is decelerated and then accelerated, and thus the muscle may be strengthened.

In order to efficiently strengthen a muscle, acceleration and deceleration of the driving speed of the joint supporter 210, and the driving direction of the joint supporter 210 may be selectively changed.

The muscle-strengthening passive and active motion device 2000 according to an embodiment of the present disclosure may further include a force sensor (not shown) for detecting force exerted from a body. For example, the force sensor may be inserted into the fastening unit 214 and detect force exerted from the body by contacting the distal end region of the body. Here, a pressure sensor or the like may be used as the force sensor. The force sensor may detect whether force is exerted and measure magnitude of the exerted force.

When the force exerted by the force is detected by the force sensor, the controller 230 may change a driving speed and driving direction of the joint supporter 210 driven by the driver 220. For example, when a patient stretches the elbow, the force sensor may detect the force exerted from the body of the patient, and in this case, the controller 230 may control the driver 220 to drive the joint supporter 210 in a direction where the elbow of the patient is stretched. On the other hand, when the patient bends the elbow, the controller 230 may control the driver 220 to drive the joint supporter 210 in a direction where the elbow of the patient is bent.

Also, when the force exerted from the body is detected, the controller 230 may control the driver 220 to further increase the driving speed of the joint supporter 210. For example, when force exerted from the body of the patient is detected while the patient is stretching the elbow, the controller 230 may control the driver 220 to drive the joint supporter 210 in the direction where the elbow is stretched and at the same time, increase the driving speed in the direction where the elbow is stretched, such that the patient moves smoothly.

Also, the controller 230 may be configured to be capable of feedback control so as to prevent damage to skin and soft tissues of the body, the damage caused by changes in acceleration and deceleration of the driving speed of the joint supporter 210 or changes in the driving direction of the joint supporter 210. For example, the controller 230 may control the joint supporter 210 so as to gradually change the acceleration or deceleration of the driving speed of the joint supporter 210, or gradually change the driving direction of the joint supporter 210. For example, when the driving speed of the joint supporter 210 is decelerated while being accelerated, the acceleration of the joint supporter 210 may be reduced by 10% at each time so as to prevent damage to the skin and soft tissues of the body. As another example, when the driving speed of the joint supporter 210 is changed, the acceleration may be gradually reduced from a certain point of time before the driving direction is changed, and then gradually increased up to a certain point of time after the driving direction is changed, so as to prevent damage to the skin and soft tissues of the body.

The muscle-strengthening passive and active motion device 2000 according to an embodiment of the present disclosure may further include a vibrating device (not shown) for vibrating the body part. For example, a vibration motor may be used as the vibrating device. For example, the vibrating device may be provided at the fastening unit 214 and the controller 230 may control the vibrating device. The vibrating device may be provided at the fastening unit 214, but a location of the vibrating device is not limited as long as vibration is transferred to the body of the patient. When the body part is vibrated through the vibrating device, a blood flow in a muscle may be increased, and thus blood may further smoothly circulate and the muscle may be strengthened. The vibrating device may be configured such that strength of vibration is adjustable and configured to vibrate even while the body part is bending or stretching.

The muscle-strengthening passive and active motion device 2000 according to an embodiment of the present disclosure may be formed of a material that is light and at the same time, solid, such as aluminum or carbon fiber, so as to simultaneously obtain light weight and solidity, but the material is not limited thereto. Also, the muscle-strengthening passive and active motion device 2000 may be configured to be used by a patient while lying down, and thus the patient may exercise easily and comfortably.

The muscle-strengthening passive and active motion devices 1000 and 2000 according to embodiments of the present disclosure bend or stretch a knee or an elbow, but the present disclosure is not limited thereto, and it is obvious that the muscle-strengthening passive and active motion devices 1000 and 2000 may be applied to any other body part that is bendable.

The invention claimed is:

1. A muscle-strengthening passive and active motion device comprising:

a joint supporter comprising a fastening unit and a support, the support comprising a front plate, a top plate, and a rear plate, wherein, the front plate is configured to move back and forth in a straight line, the front plate is connected with the fastening unit and the top plate by a first link, the top plate is connected to the rear plate by a second link, and the top plate is connected between the front plate and the rear plate, and is configured to move upward and downward;

an extension plates provided at one end portion of the top plate through a fourth link, wherein a support member is connected between the extension plate and the rear plate through a fifth link and a sixth link;

a driver driving the joint supporter by being combined to the joint supporter, wherein the driver comprises:

a power generator generating power; and a power transmitter combined to the power generator and driving the joint supporter by using the power from the power generator; and a controller controlling the driver, wherein the controller is capable of accelerating or decelerating a driving speed of the joint supporter, wherein the front plate is directly connected to the power transmitter via a nut for moving back and forth in the straight line.

2. The muscle-strengthening passive and active motion device of claim 1, wherein the joint supporter further comprises a shock-absorbing unit.

3. The muscle-strengthening passive and active motion device of claim 1, wherein the controller selectively accelerates or decelerates a driving speed of the joint supporter.

4. The muscle-strengthening passive and active motion device of claim 1, wherein the controller selectively changes a driving direction of the joint supporter.

5. The muscle-strengthening passive and active motion device of claim 1, wherein the fastening unit further comprises a strap for wrapping and fastening.

6. The muscle-strengthening passive and active motion device of claim 1, wherein the fastening unit has a plate shape, and one surface of the fastening unit has a groove.

* * * * *